US009551200B2

(12) United States Patent
Read et al.

(10) Patent No.: US 9,551,200 B2
(45) Date of Patent: Jan. 24, 2017

(54) INTENSIFIER RAM BLOWOUT PREVENTER

(71) Applicant: BOP Technologies, LLC

(72) Inventors: Herbert Jay Read, Huntsville, TX (US); Mark F. Alley, The Woodlands, TX (US)

( * ) Notice: Subject to any disclaimer, the term of this patent is extended or adjusted under 35 U.S.C. 154(b) by 122 days.

(21) Appl. No.: 14/448,417

(22) Filed: Jul. 31, 2014

(65) Prior Publication Data

US 2015/0034298 A1 Feb. 5, 2015

Related U.S. Application Data

(60) Provisional application No. 61/861,095, filed on Aug. 1, 2013.

(51) Int. Cl.
*E21B 33/06* (2006.01)
*F15B 3/00* (2006.01)

(52) U.S. Cl.
CPC ..... *E21B 33/063* (2013.01); *E21B 33/062* (2013.01); *F15B 3/00* (2013.01)

(58) Field of Classification Search
CPC .... E21B 33/061; E21B 33/062; E21B 33/063; F01B 7/16; F15B 3/00
USPC ..... 251/1.1, 1.2, 1.3; 91/151, 173, 535
See application file for complete search history.

(56) References Cited

U.S. PATENT DOCUMENTS 1,569,247 A 1/1926 Abercrombie et al.
2,986,367 A * 5/1961 Le Rouax ..... E21B 33/06 251/1.3
3,614,111 A * 10/1971 Regan ..... F16K 7/075 166/84.4
4,071,085 A * 1/1978 Grable ..... E21B 33/06 166/84.4
4,214,605 A 7/1980 Hardgrave
4,558,842 A * 12/1985 Peil ..... E21B 33/062 251/1.3
4,864,914 A * 9/1989 LeMoine ..... F15B 3/00 251/1.3
5,918,851 A 7/1999 Whitby
6,085,501 A * 7/2000 Walch ..... A01B 63/10 172/7
7,779,918 B2 8/2010 Cowie et al.
8,353,338 B2 1/2013 Edwards
2005/0242308 A1 11/2005 Gaydos
2009/0127482 A1 5/2009 Bamford
2011/0278488 A1* 11/2011 Feser ..... F16K 27/02 251/324
2013/0025689 A1 1/2013 Yadav
(Continued)

*Primary Examiner* — Kevin Murphy
*Assistant Examiner* — Jonathan Waddy
(74) *Attorney, Agent, or Firm* — Hulsey P.C.

(57) ABSTRACT

An apparatus for containing pressure associated with a well includes a ram fluid chamber, a ram piston, and an intensifier piston within a housing. The ram piston has ends associated with a ram and with the ram fluid chamber. The intensifier piston has ends associated with the ram fluid chamber and a fluid source. The end of the intensifier piston associated with the fluid source has a larger surface area than the end associated with the ram fluid chamber. Fluid from the fluid source applies a first pressure to the second end of the intensifier piston to move the intensifier piston. Movement of the intensifier piston applies a second pressure greater than the first pressure to fluid in the ram fluid chamber to move the ram piston and associated ram toward a closed position.

15 Claims, 9 Drawing Sheets

(56) References Cited

U.S. PATENT DOCUMENTS

| | | | | |
|---|---|---|---|---|
| 2013/0098628 | A1* | 4/2013 | Van Wijk | E21B 33/0355<br>166/368 |
| 2013/0220627 | A1* | 8/2013 | Coppedge | E21B 33/038<br>166/345 |

* cited by examiner

INTENSIFIER RAM BLOWOUT PREVENTER

CROSS-REFERENCE TO RELATED APPLICATIONS

The present application claims the priority benefit of the co-pending U.S. Provisional Application for Patent, having the Application Ser. No. 61/861,095, filed Aug. 1, 2013, which is incorporated by reference herein in its entirety.

FIELD

Embodiments usable within the scope of the present disclosure relate, generally, to blowout preventers ("BOPs"), e.g., usable in conjunction with subterranean and/or subsea wellbores, and more specifically, to blowout preventers adapted to provide enhanced/intensified pressure to the rams thereof when actuated.

BACKGROUND

BOPs are commonly used for well control in oil and gas wells and other subterranean exploration and production activities, especially during drilling operations, completion operations, and production of hydrocarbons (or other matter) encountered under pressure from a well. The use of BOPs is required by law in most regions where oil and gas drilling operations are performed BOPs have been used in the oil and gas industry for nearly a century, as illustrated in U.S. Pat. No. 1,569,247, which is incorporated by reference herein in its entirety. Conventional BOPs utilize radially opposing hydraulic ram blocks. As hydraulic fluid is forced into a piston configured within the rams inside each ram module, the rams converge (e.g., move in an inward direction), typically to contact one another to seal a wellbore. While rams can be used to cut and/or displace a tubular, or seal around a tubular, various types of BOPs can be used to seal a well independent of whether the wellbore contains a tubular. Controlling unwanted or unexpected pressure in a wellbore is critical to maintaining a safe work environment and safe equipment, and preserves both the environment and the reservoir.

Different types of BOPs have evolved over the years to address different problems in various drilling scenarios. Standard practice in the offshore oil and gas industry is the use of tall "stacks" of multiple BOPs, which may vary in type, configuration, as well as redundancy of features.

Standard practice in the oil and gas industry involves use of ram-type blowout preventers. Ram-type blowout preventers are generally regarded as reliable in situations in which the highest, most dangerous pressures may be encountered. Since the development of the first BOPs in the 1920s, the design/configuration of ram-type BOPs has changed only slightly, at least in terms of mechanical function, and these changes are generally limited to the addition of hydraulic force and modern controls. Radially opposing ram blocks, that is, ram blocks positioned on opposite sides of the wellbore and contained in a BOP housing, are generally hydraulically actuated to "close", and make contact in the center of the wellbore, providing a seal against wellbore pressure. In this closing operation, a seal may be formed around any tubular in the wellbore, through contact between rams if using blind ram blocks (e.g. no tubulars), or through contact between rams when shear rams are used, e.g., to shear and seal tubular(s). The rams generally include ram block sealing surfaces formed from extendable, expandable, extrudable rubber, or rubber "packers" on the ends thereof, that are formed with the required shape and flexibility to form a seal around a tubular, or against an opposing ram in the case of shearing or in the absence of a tubular.

The BOP housing that contains the ram cavity and ram blocks has an open center for placement over the wellbore and allowing space for tubulars, such as a drill string, that may pass through the BOP housing and into or above the wellbore. Recently, in order to generate sufficient pressure during actuation to shear tubulars of significant strength, the movement of pistons in the rams requires a great deal of external room—significant external space sufficient for placement of large hydraulic cylinders and an accordingly large amount of hydraulic fluid. This required space is seen in the form of the lateral extension of roughly linear hydraulic cylinders away from, and transverse or perpendicular to, the main BOP housing, and opposite an opposing ram block. The introduction of hydraulic fluid under pressure into the cylinder actuates the ram(s) toward a closed position. Thus, large cylinders and external housings (extending in opposite directions from the ram block, laterally outward from the BOP housing) are critical to the function of conventional BOPs. These cylinders with their external housings require great amounts of space in both lateral directions and add great mass to the entire BOP in order to increase force necessary to execute a closing operation. As such, conventional BOPs possess a large and unwieldy footprint, requiring extensive planning as well as powerful equipment for placement over the wellbore.

U.S. Pat. No. 7,779,918, which is incorporated by reference herein in its entirety, describes a compact wellbore control device that utilizes hydraulic pistons to actuate linkages that in turn force rams together in a "close" operation. This wellbore control device appears to provide a relatively compact, although mechanically complex, means of severing a small diameter tubular, such as the referenced workstring, within a riser pipe, but is primarily suitable only for operations performed on a relatively small diameter tubular.

U.S. Pat. No. 8,353,338, which is incorporated by reference herein in its entirety, describes an alternate means of hydraulically moving a shear assembly outward with the trailing edge of a shear assembly, rather than the leading edge, moving slightly across the wellbore and executing the shear of a tubular. As noted, traditional ram BOPs utilize the leading edge of a shear assembly that is making an inward, or toward and then slightly across the wellbore movement, in a sealing and shearing operation.

It should be well noted that tubular shearing (and resultant sealing) operations require more force than other BOP closing operations. Typically, the increased energy required for shearing operations is generated by adding booster cylinders to the end of existing ram hydraulic cylinders. The added booster cylinders add mass and further increase the already-large BOP footprint.

A flanged, bolt-on "bonnet," or a hinged "door," with a contiguous (from the flange or door) extended hydraulic cylinder housing is the typical means by which a conventional BOP cylinder is attached the BOP housing. As described previously, this flanged or hinged housing extends perpendicularly or transversely outward from the main BOP housing. Such bonnets are typically bolted to the main BOP body with a number of large, heavy bolts, while hinged doors are joined to the main BOP body by large hinges. Removal of the bolts and/or hinges is a very time-intensive and laborious endeavor. In recent years, "boltless" doors have been developed, which utilize a different locking mechanism, though large hinges on the doors still consume significant space, which is compounded by the large swing-arc space required to open the door. Accommodations for large hinge doors may interfere with placement of other equipment and/or service efforts under certain circumstances.

Ram BOPs traditionally utilize "open" and "close" ports in the BOP body to channel hydraulic fluid to the rams and actuate them toward the open or close position, respectively. As fluid enters one end of a ram cylinder on one side of the piston-ram-shaft assembly, it will displace fluid contained in the cylinder on the other side of the piston. BOPs are designed with appropriate ports, passageways and accumulators to accommodate the fluid movement that actuates a BOP between open and close positions. A closing operation closes the rams when required, and the "open" operation retracts the rams to an open position when deemed appropriate and safe.

Conventional BOPs are relatively reliable, if cumbersome, having a significant number of moving parts and wear parts. The power of a conventional BOP to deliver sealing or shearing force remains closely correlated to the BOP's size, with an increase in deliverable force resulting in a significant increase in the footprint of the BOP. Due to the fact that modern wells are drilled to significant depths and encounter very significant pressures, both on land and in offshore subsea installations, BOPs and BOP stacks are becoming extremely heavy and occupy enormous footprints. Yet even with the size and power of conventional BOPs, serious pressure-related oilfield accidents and mishaps continue to plague the industry.

SUMMARY

Embodiments usable within the scope of the present disclosure relate to methods for controlling, sealing, and/or shearing and sealing wellbore tubulars, through hydraulic and/or gas assisted operations, and devices (e.g., blowout preventers) capable of such methods. Embodied BOPs can utilize fewer and simpler parts than conventional BOPs, while applying equal or greater force to the rams thereof, significantly reducing the mass and footprint of devices when compared to conventional BOP housings, cylinders, bolt-on bonnets, and/or hinged doors. For example, embodiments usable within the scope of the present disclosure can be utilized without requiring bonnets or doors. Further, embodiments usable within the scope of the present disclosure include BOPs that are generally failsafe under nearly any circumstances.

In an embodiment, a blowout preventer can include an integrated, self-contained pressure intensifier usable to deliver force/pressure to the BOP rams in excess of conventional alternatives. In the event hydraulic power is unavailable for any reason, one or more embodiments can include a gas reservoir in communication with the intensifier, adapted to release gas to apply sufficient pressure to the intensifier to independently perform a sealing and/or shearing operation. In an embodiment, the BOP can provide compact footprint and/or weight, e.g., through using no bonnets or doors, and thereby eliminating the use of cumbersome bolts and/or similar attachment features used in conjunction with bonnets and doors. For example, in an embodiment, a single locking pin or screw could be used to provide access to a ram module, enabling efficient ram maintenance, while reducing the overall weight and footprint of the device. This reduction in structure, weight, and footprint can be accomplished using a method for actuation of the rams that deviates from conventional alternatives.

In an embodiment, an intensifier can be an integral and enclosed part within the BOP housing. In use, the intensifier can enable application of an intensified hydraulic pressure, e.g., through use of a piston, plunger, and/or similar member having sides with differing surface areas to multiply the pressure received at a first side of the intensifier, and applying this multiplied force to the rams to perform a sealing and/or shearing operation. Force applied to the rams in this manner can be significantly greater than that of a comparably sized conventional BOP, and provide adequate sealing and/or shearing force for any conceivable wellbore incident. For example, use of enhanced pressure/force applied to the rams can enable embodied BOPs to efficiently shear any oilfield tubular, including exotic and/or modern, high-strength tubular materials that can often become an impediment for conventional BOP rams.

In an embodiment, all intensified pressure can be contained within the upper housing and ram module of the BOP, thereby eliminating the possibility of pressure being released by exterior fittings or fasteners. A lower housing can be included (e.g., a bolt-on circular and/or "washer" shaped plate, with ram shaft access ports), that can be rotated relative to the upper housing to position the ram shaft access ports in any desired and/or convenient orientation.

In an embodiment, the BOP can be provided with a circular and/or cylindrical shape, e.g., concentric to the wellbore, which provides the BOP with an exceptionally strong and compact form lacking any structural corners or structural welds that could become potential failure points. The circumferential strength of such a shape can enable the BOP to withstand greater pressures while utilizing less mass and material than conventional ram BOPs. In various embodiments (e.g., circular-shaped BOPs), no welding is required, but rather only machining of the BOP, resulting in easier and/or more efficient manufacture.

In an embodiment, the BOP can include an associate gas reservoir (e.g., bolted or otherwise mounted to the BOP). In use, the gas booster reservoir can be used in conjunction with the BOP's hydraulics to boost hydraulic pressure, or in the event that hydraulic pressure is unavailable for any reason, the gas booster reservoir can be provided with sufficient fluid and/or components to be used independently, in place of hydraulic power, to move the BOP rams toward a closed position unassisted. The gas booster reservoir may be constructed so as to be sufficiently robust to execute any required shearing and sealing operation, including shearing of modern and/or exotic and/or high strength tubular materials. The gas booster reservoir can include a release valve that may be actuated by a variety of methods. Use of a gas reservoir can enable an embodied BOP to be generally failsafe. For example, while use of a gas booster reservoir is not required for normal function of various embodiments of the disclosed blowout preventer, use of such reservoirs may become standard practice in the industry.

In various embodiments, a blowout preventor can utilize approximately one half the number of parts found in a conventional BOP, or fewer, such as through the elimination of bonnets and doors, structural configurations to reduce mass/footprint, etc. As described previously, elimination of bonnets an doors results in the elimination of associated bolts, hinges, and similar mounting features. In an embodiment, hydraulic ram modules can be retained in place by a sufficiently robust retaining member, such as an insertable member, thus eliminating the need for bolts and conventional bonnet/door assemblies while simplifying the manufacture, assembly and maintenance of the BOP. For example, in an embodiment, ram module maintenance can be performed by simply removing a locking pin or screw that allows the retaining member to slide outward (e.g., laterally or perpendicularly) relative to the rear portion of the ram module, thereby allowing removal of the ram module itself, e.g., for maintenance, as needed.

In an embodiment, an indicator (e.g., a mechanical indicator) can be used, e.g., to verify the position of the piston ram shaft and ram block piston. For example, the piston ram shaft can include an access tube permitting external access to the hollow cylindrical center of the piston ram shaft. A position indicator rod may positioned in association with the ram shaft, to slide inward toward the wellbore and outward away from the wellbore as the ram shaft moves. A locking device, such as a ball screw may function as the position indicator, moving inward to lock the piston ram shaft if hydraulic power is disengaged, while also serving as a visual indicator of inward piston ram shaft and ram block movement. Such indicators can provide a continuous visual reference by which an external observer can verify ram piston and shaft position, without relying on other mechanisms. In an embodiment, electronic sensors, such as linear transducers or can be incorporated; however, a mechanical ram position indicator can be included for use in the event electronic sensors are unavailable for any reason.

In an embodiment, a BOP can include a ram shaft locking device usable to retain a ram shaft in a closed position even at times when hydraulics have been bled off after a closing operation.

Although several embodiments and advantages thereof are described herein, any particular embodiment need not contain all of the advantages and/or features listed. Furthermore, additional advantages and/or features can become apparent through a reading of the appended Detailed Description and accompanying figures, and the features and advantages of the disclosed subject matter are not limited to the foregoing.

DETAILED DESCRIPTION

Figure 1:
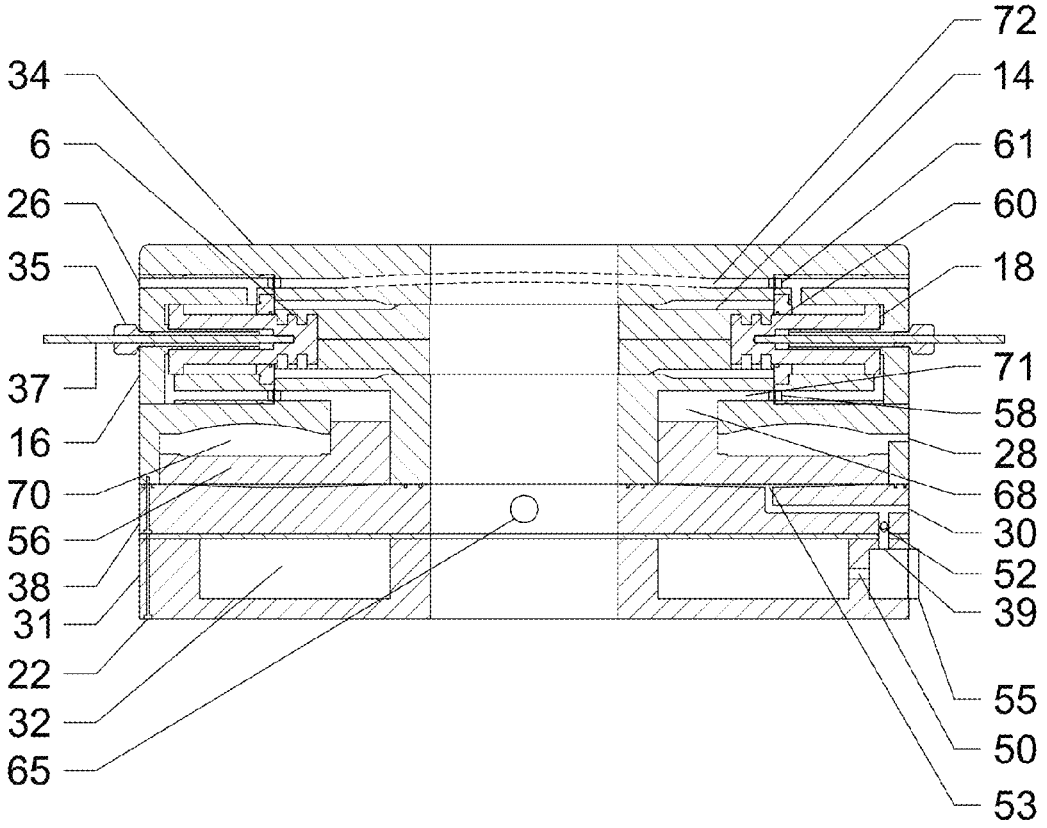
FIG. 1 is a side cross-sectional view of an embodiment of a blowout preventer (BOP) usable within the scope of the present disclosure, depicted in an open position, illustrating cut-away views of a pressure intensification system, a gas booster reservoir, a ram module, and a locking mechanism (shown as a hydraulically actuated ball screw).
Figure 2:
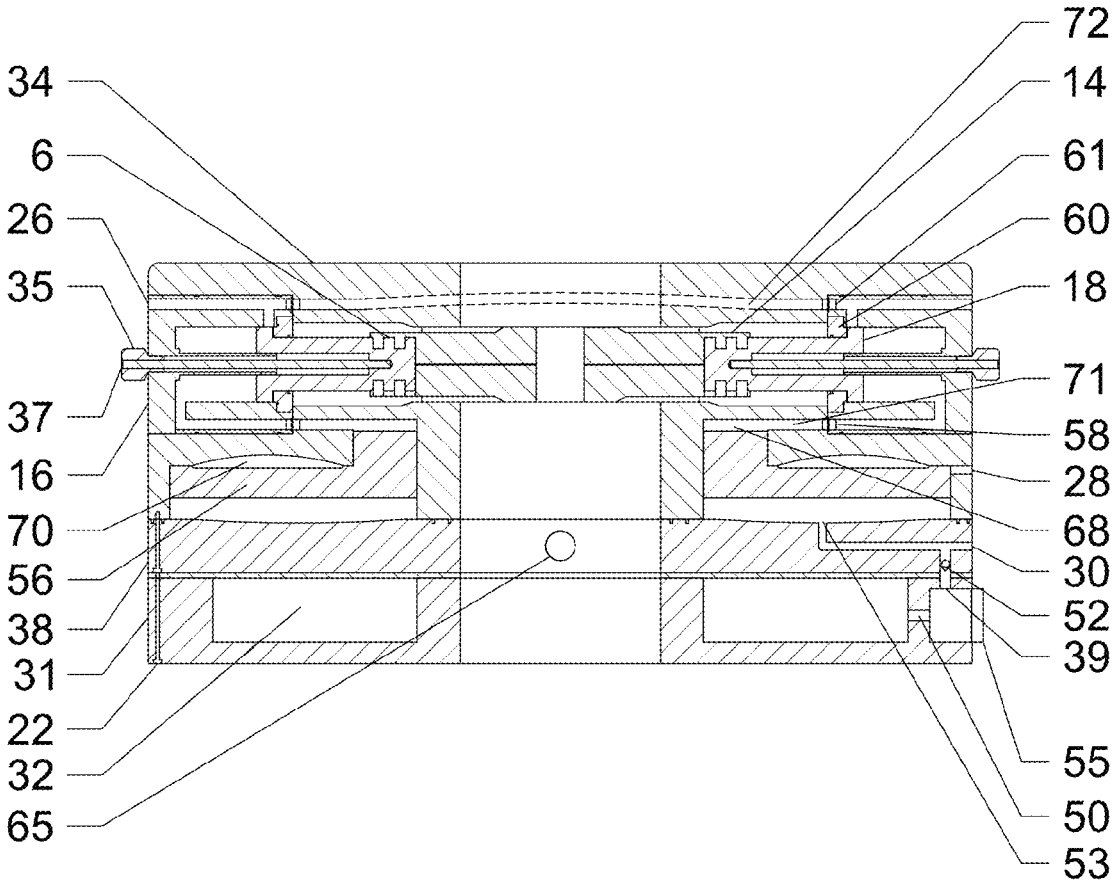
FIG. 2 is a side cross-sectional view of the BOP of FIG. 1 in a closed position, e.g., after travel of an intensifier piston in an upward direction, such that resulting fluid pressure moves the piston ram shaft and associated components in an inward direction (e.g., toward the wellbore.)
Figure 3:
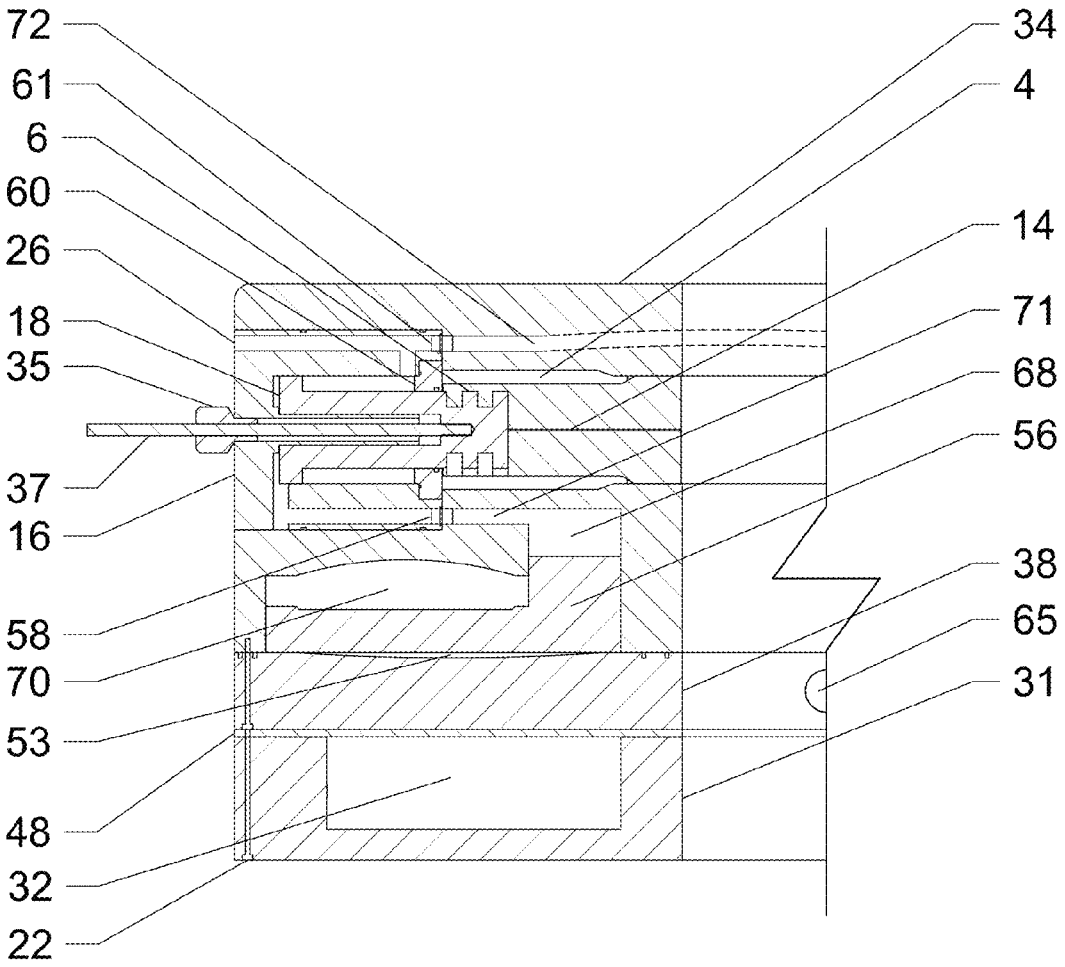
FIG. 3 is a side cross-sectional view of one half of the BOP of FIG. 1, shown in the position, illustrating a view parallel to the piston ram shaft and ball screw and perpendicular to retaining members usable to retain the ram module.

Referring to FIG. 1, FIG. 2, FIG. 3, and FIG. 6, an embodiment of a blowout preventor (BOP) usable within the scope of the present disclosure is shown ,the BOP including an upper housing 34 joined to one or more lower housings 38, and similarly, joined to a gas booster reservoir housing 31 by a plurality of fasteners 22, such as studs, socket head cap screws, or other types of fasteners. For example, FIGS. 1-3 depict a fastener inserted at the lower left portion thereof, proximate to the outer edge/circumference of the BOP. The number, type, and arrangement of fasteners can be varied depending on operational requirements, and usable fasteners can include studs, bolts, screws, or any other type of fastener and can be secured, for example, using retaining members such as nuts (e.g., nylon insert lock nuts, polymer insert lock nuts), or socket head cap screws. While FIGS. 1-3 depict fasteners such as studs or socket head cap screws extending through the lower housing 38 and gas booster reservoir housing 31 into the upper housing 34, it should be understood that separate sets of fasteners could be used to attach each housing portion, and that in various embodiments two or more housing portions could be integral with one another. In an embodiment, the same fastener 22 size can be used on a variety of BOP sizes, facilitating manufacture, repair, replacement, maintenance, and maintaining an inventory of parts. In an embodiment, a flanged connection or other type connection can be utilized in place of the studded connection or in addition thereto. For ease of manufacture, assembly and maintenance, in one embodiment, the upper housing 34 is joined to the lower housing 38 at an attachment point below intensifier piston 56, with the fasteners 22 being inserted from the bottom of the BOP.

In the depicted embodiment, a button-style 6 piston ram shaft 18, although it should be understood that the piston ram shaft 18 can have any design and/or configuration, depending on the operational constraints related to a wellbore. In an embodiment, the piston and ram shaft can be a single unit, e.g., a "piston ram shaft" 18. However, as described previously, the BOP can be adapted to accept different styles of piston-ram shaft to ram block configurations, including but not limited to the depicted piston ram shaft 18, ram module 16, and piston ram shaft retainer ring 60. The BOP, ram cavity 4 shown in FIG. 3 and ram module 16 can be modified to accept virtually any piston assembly from any manufacturer. Seal sub assemblies 39, 58 and 61 can be utilized to seal across separate solid surfaces that may experience some movement, vibration and/or shifting.

Referring to FIG. 1 and FIG. 2, a side cross-sectional view the embodied BOP is shown, with an axial opening extending through the center, e.g., for placement over a borehole or wellbore. The depicted BOP is generally contiguous and roughly cylindrical in shape. FIG. 1 depicts the BOP in an open position, while FIG. 2 depicts the BOP in a closed position, e.g., after a closing operation has been executed. The BOP is actuated (e.g., toward a closed position) as hydraulic fluid flows under pressure through either a close port 30, or through a multi-port valve 55, in which case hydraulic fluid would flow through seal sub assembly 39, through check valve 52, and to the low pressure side 53 underneath the intensifier piston 56. As hydraulic fluid flows to the low pressure side 53 under the intensifier piston 56, pressure is exerted on the bottom of the intensifier piston 56, thereby moving the intensifier piston 56 upward and exerting pressure on the intensified pressure chamber 68, located above the intensifier piston 56. Additionally, as intensifier piston 56 is forced upward, any gas or fluid contained in the intensifier gas accumulation chamber 70 can be compressed. In an embodiment, the intensifier gas accumulation chamber 70 can be filled with a compressible fluid or gas, such that the compression of the fluid or gas does not significantly impede the travel of intensifier piston 56. Alternatively, such fluid or gas can be vented through a vent port vent port 28, e.g., into the atmosphere and/or another region external to the BOP. In an embodiment, fluid or gas in intensifier gas accumulation chamber 70 could be captured by an accumulating device (not shown). In another embodiment, gas or fluid can be retained in the intensifier gas accumulation chamber 70, such that the compressed fluid can exert a downward force on intensifier piston 56, e.g., to assist in an open operation after a closing operation has been executed.

As described previously, FIGS. 1-3 show a representative fastener 22 positioned in the lower left portion of the BOP; however, in various embodiments, a plurality of fasteners can be spaced about the circumference of the BOP to join the upper housing 34, lower housing 38, and gas booster reservoir housing 31 (if present) at multiple connection points.

The intensifier piston 56 can function to conceptually divide the housing into a low pressure side 53 (e.g., below intensifier piston 56) and a high pressure side (e.g., the intensified pressure chamber 68 and portions of the BOP above the intensifier piston) caused by the relative difference in surface areas of the bottom of intensifier piston 56 and the portion of intensifier piston 56 disposed in the intensified pressure chamber 68. In use, the hydraulic pressure of fluid on each side of the intensifier piston 56 varies in the same ratio, or proportion, of the larger geometric area (the bottom side of the piston) to the smaller area (the top side of the piston). For example, a desired intensified pressure can be achieved simply by constructing an intensifier piston and volumetric cavity to desired proportions, creating the desired ratio, or factor of intensified fluid pressure, as well as a desired volume of fluid.

Figure 4:
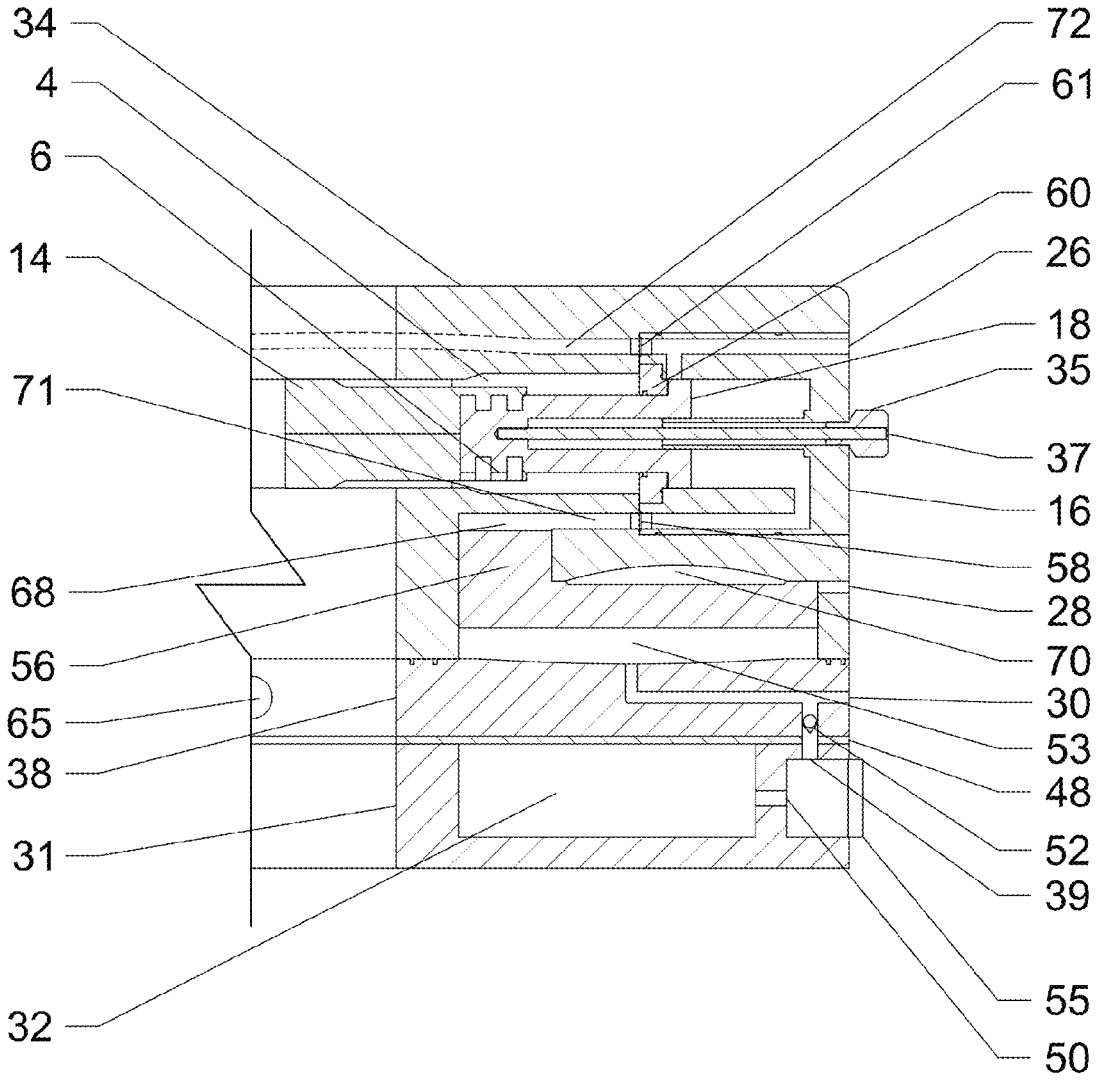
FIG. 4 is a side cross-sectional view of the half of the BOP of FIG. 1 not shown in FIG. 3, depicted in a closed position, illustrating a view parallel to the piston ram shaft and ball screw and perpendicular to the retaining members.

FIGS. 3 and 4 depict exploded cross-sectional views of the left and right halves, respectively, of the BOP. In use, the "high pressure" hydraulic fluid in the intensified pressure chamber 68 can be forced through high pressure passageway 71 and through a seal sub assembly 58, to the proximal or "close" side of the FIG. 3 and FIG. 4 piston ram shaft 18 (e.g. the side of the piston ram shaft 18 closest to the ball screw assembly 35). This fluid in turn exerts pressure on and actuates the piston ram shaft 18, causing the piston ram shaft to move inward toward the wellbore 64, thereby advancing the attached ram block 14 inward for sealing and/or shearing of a wellbore tubular and/or the wellbore 64. A closing operation, shown completed in FIG. 4, can result in sealing, or shearing and resultant sealing, depending on the ram block 14 configuration used. During a closing operation, hydraulic fluid can travel farther through the intensified pressure chamber 68 and into ram module 16 arriving at the base, or back side, of the piston ram shaft 18, through seal sub assembly 61, into the open port passageway 72, and exit the upper BOP housing 34 at the open port 26, to which a hydraulic pumping unit or accumulator device (not shown) may be attached. When hydraulic fluid flows into the open port passageway 72, the fluid entering the passageway can pass out of both opposing ram modules 16. The passageway connected between both ram modules 16 is shown in FIGS. 1-4 as dashed line, which is also part of open port passageway 72. In one embodiment, hydraulic fluid does not begin to flow into open port passageway 72 until the piston ram shaft 18 is fully deployed. In another embodiment, there a valve on open port 26 can be closed during a closing operation, then opened to release the pressure exerted on piston ram shaft 18 and permit movement of the ram shaft 18 in a reverse direction. Alternatively or additionally, such a valve could also be located in an external accumulator or hydraulic pumping unit.

When a gas booster reservoir 32 is used in lieu of the release of hydraulic fluid, the vent port 28 can be retained in a closed position to allow gas to accumulate in the intensifier gas accumulation chamber 70 rather than passing through the vent port 28. Alternatively, the vent port 28 can be open to allow gas to flow therethrough at a desired pressure, e.g., into an accumulator device (not shown) or hydraulic pumping unit (not shown).

If the BOP has been activated and is in a closed position, as shown in FIG. 4, the BOP can be returned to an open position by retracting the ram block 14 and piston ram shaft 18. For example, flow can be reversed from an external hydraulic pumping unit (not shown) or accumulator (not shown) to pass through the "open" port 26 and through the open port passageway 72 and seal sub assembly 61, exert pressure on the "open" side of piston ram shaft 18 and actuate piston ram shaft 18 in an outward direction away from wellbore 64, simultaneously retracting ram block 14 away from wellbore 64. During an opening operation, hydraulic fluid can pass through high pressure passageway 71 and exert pressure on intensifier piston 56, causing the intensifier piston to travel downward toward its starting or "open" position. If an external accumulator or capturing device (not shown) or hydraulic pumping unit (not shown) is used in association with the gas accumulation chamber 70, travel of the intensifier piston 56 can possibly create a vacuum in the gas accumulation chamber 70, resulting in fluid or gas being drawn in from the vent port 28. The vent port 28 could also draw fluid from an ambient environment external to the BOP, e.g., in the absence of an external accumulator or pumping unit. At the conclusion of an opening operation, the piston ram shaft 18 and intensifier piston 56 can be returned to their or starting positions, as shown in FIG. 1 and FIG. 3.

Although the hydraulic actuation of the intensifier piston 56 can result in the application of a significant amount of force to the piston ram shaft 18 and ram block 14 in a sealing and/or shearing operation, a situation may arise in which an operator may wish to verify that a shearing and/or sealing operation has been completed successfully. For example, an operator may wish to verify that adequate force has been applied to shear any tubular of any material, and to obtain visual conversation that the ram blocks 14 have traveled a sufficient distance to ensure tubular shear.

Actuation of the intensifier piston 56 results in the entry of high pressure fluid in the intensified pressure chamber 68, at a multiplied pressure of that of the fluid entering the "close" port 30 or multi-port valve 55. Conventional ram BOPs may operate, for example, with ram cylinder input pressures of 5,000 psi, or a similar pressure. Depending on intensifier geometry used in the embodiments described herein, if an input pressure of 5,000 psi passes through the "close" port 30 or multi-port valve 55, the resulting intensified pressure to actuate piston ram shaft 18 and ram block 14, could be, for example, five times the pressure entering the "close" port (e.g., approximately 25,000 psi). Such pressures are unprecedented in the art of blowout preventers and far exceed the pressure required to shear any tubular currently known. Should an operator deem that hydraulic pressure alone may be, for any reason, inadequate to execute a tubular shearing operation, the gas booster reservoir 32 can be used to provide additional pressure to assist the hydraulics, provided the gas booster is charged at a higher pressure than the hydraulics. If used in this manner, the gas booster reservoir 32 can release gas through the multi-port valve 55 and apply additional pressure to the hydraulic fluid that has already entered through the "close" port 30. Pressure from the gas booster reservoir 32 can similarly be multiplied by the intensifier piston, resulting in higher pressure in the intensified pressure chamber 68 and driving the piston ram shaft 18 and ram block 14. The multi-port valve 55 releasing gas booster reservoir 32 gas can be actuated by any means, including, without limitation, mechanical, hydraulic, electrical, wireless and/or acoustic switching, with appropriate timing devices correlated to the flow through the "close" port 30 or flow through multi-port valve 55. In an embodiment, the gas booster reservoir 32 can be adapted for remote actuation/operation, e.g., at the exterior of the BOP body itself, such as by an ROV (remotely operated vehicle). Therefore, the gas booster reservoir 32 can operate as a fail-safe, in addition to or in lieu of providing additional pressure for sealing/shearing operations.

Referring to FIG. 3 and FIG. 4, verification of successful sealing and/or shearing operation, and/or verification of function of the ram module 16 and piston ram shaft 18 in general, can be indicated by the position of a ram position indicator rod 37. In the depicted embodiment, the position indicator is shown as a ball screw. The depicted ram position indicator rod 37 functions mechanically, and is comprised of a rod that may be contained inside a space in the center of piston ram shaft 18 and may be attached, in this inner space, to the edge of the piston ram shaft 18 closest to the ram block 14. The ram position indicator rod 37 can move inward into the inner diameter of a roughly cylindrically shaped space in the piston ram shaft, and thus, follow piston ram shaft 18 during performance of a closing operation. As shown, the roughly cylindrically shaped space and walls within which position indicator rod 37 travels can include a hollow central portion of the piston ram shaft 18 and a portion of ram module 16. The depicted ram position indicator rod 37 is roughly concentrically disposed relative to the center of the piston ram shaft 18. In one embodiment, the ram position indicator rod 37 can include a ball screw or lead screw. In the case of a ball screw, the ball screw may be contained inside a space in the center of piston ram shaft 18 and, while not attached, may be in close proximity to the edge of the piston ram shaft 18 closest to the ram block 14, and in an embodiment, could be permitted to touch the edge of the piston ram shaft 18. In the case of a ball screw, during a closing operation, a motor operated by hydraulic fluid flow and pressure from the operation can force the ball screw inward into the roughly cylindrically shaped space, as high pressure hydraulic fluid forces the piston ram shaft 18 inward toward the wellbore 64. As such, the ram position indicator rod 37 "follows" the ram block 14 inward toward the wellbore 64. The ram position indicator rod 37 can be calibrated to travel inward in direct proportion to the distance the piston ram shaft 18 moves inward. The ram position indicator rod 37 can protrude externally from the upper housing 34 and provide a visual indication of a position of ram block 14 and piston ram shaft 18 position in relation to the BOP and the wellbore 64. While FIG. 3 and FIG. 4 depict a ball screw that serves the function of ram position indicator rod 37, with visible indication provided by how far the ball screw has traveled toward the wellbore 64, other types of members capable of moving relative to other portions of the BOP and/or indicating the position of the ram piston can be used without departing from the scope of the present disclosure.

Figure 9A:
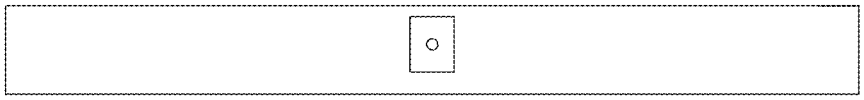
FIG. 9A shows a side view of the exterior of an embodiment of the gas booster reservoir, shown in FIG. 1 in conjunction with the BOP depicted therein.
Figure 9B:
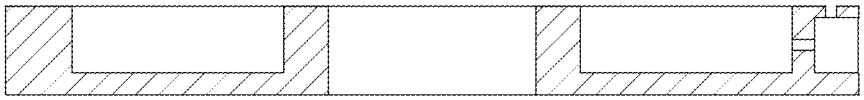
FIG. 9B shows a side cross-sectional view of the gas booster reservoir of FIG. 9A, illustrating porting on a side thereof.

FIG. 9A depicts a side view of the exterior of the gas booster reservoir used in conjunction with the BOP shown in FIG. 1, the reservoir including a housing with charge port and multi-port valve. FIG. 9B shows a side, cross-sectional view of the gas booster reservoir. As described previously, in the event hydraulic fluid pressure is unavailable or undesired for use for any reason, the gas booster reservoir housing 31, containing gas booster reservoir 32, can be used. In an embodiment, the reservoir can be attached (e.g., bolted) to the lower housing 38, and may be operated independently (e.g., independent of the hydraulic operation of the remainder of the BOP). As such, in various embodiments, a closing operation can be executed without use of external hydraulic pressure, e.g., via fluid entering the "close" port 30 or multi-port valve 55, by instead utilizing fluid within the gas booster reservoir. For example, in a scenario where external hydraulic lines have been destroyed in an emergent incident, a self-contained, enclosed, integrated gas booster reservoir 32 can be actuated as described previously to release gas (or another fluid) through multi-port valve 55, and can be filled and/or pressurized sufficiently that independent of external hydraulic pressure, the gas booster reservoir can supply sufficient pressure on its own, taking into account the pressure multiplication of the intensifier piston 56, to seal and/or shear and seal the wellbore 64 tubulars or seal an open wellbore 64. In various embodiments, the gas booster reservoir 32 can be designed for a single use, e.g., until the gas booster reservoir 32 is recharged through the gas charge port 50. For example, while pressure may be bled off from the depicted gas booster reservoir to enable retraction of piston ram shaft 18 and ram block 14 to the open position shown in FIG. 1 and FIG. 3, the depicted gas booster reservoir 32 will not recharge through this process, but can be recharged through the gas charge port 50 to enable the gas booster reservoir to perform a subsequent closing operation. In other embodiments, however, the gas booster reservoir could be designed to receive reverse flow during an opening operation, to recharge automatically (e.g., via a compressor), and/or could be provided with sufficient gas and/or pressure to perform multiple closing operations. The depicted gas booster reservoir 32 is usable as an attachment to the BOP, which may be bolted and/or otherwise secured thereto, as shown in FIG. 1, FIG. 2, FIG. 3, FIG. 4, FIG. 6 and FIG. 7, utilizing sealing surface 48, which can include, for example, a seal ring fitting snugly between gas booster reservoir housing 31 and lower housing 38. In one embodiment, an applicable seal ring, not shown in detail, can have the shape of a contiguous, large washer, with appropriate adaptations for elastomeric or other sealing surfaces, and can extend from the outer circumference of the BOP at sealing surface 48 to the axial bore extending through the center over the wellbore 64, with said seal ring also having a hole of similar or identical diameter through the center thereof. While FIG. 9B depicts the gas booster reservoir 32 having a cavity usable to contain compressed gas, in various embodiments, a gas booster reservoir could contain a manufactured, ready-made compressed gas cylinder or other compressed gas vessel, or a plurality of such cylinders or vessels. Such vessels could be configured and connected so as to charge and operate in the same or similar manner as the depicted gas booster reservoir 32.

Figure 5:
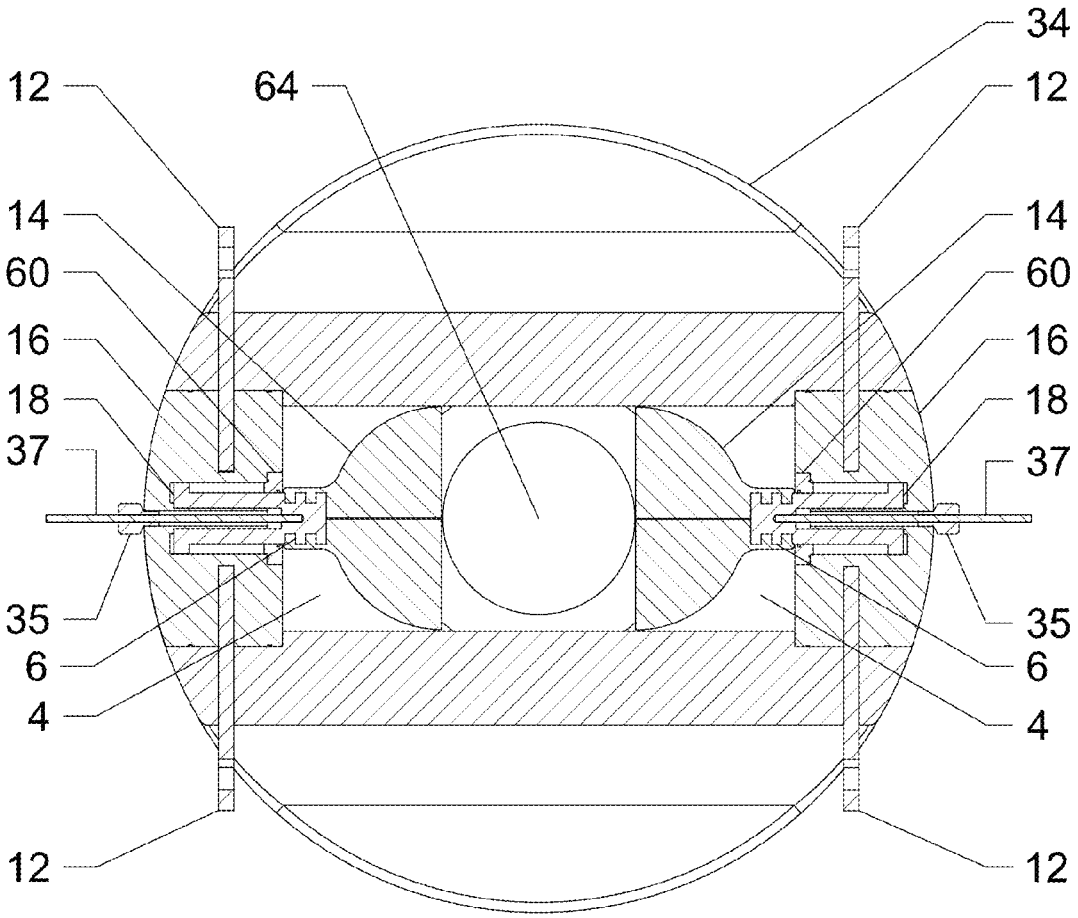
FIG. 5 is a top cross-sectional view of the BOP of FIG. 1, illustrating opposing ram block assemblies, retaining members, and a round outer circumference of the BOP housing.

Referring to FIG. 5, a top, cross-sectional view of the BOP of FIG. 1 is shown, illustrating opposing ram modules 16, ram block 14 assemblies, retaining members 12 and the outer, round circumference of the BOP housing comprised in part by upper housing 34. The wellbore 64 is visible in the approximate center of this overhead view.

Figure 6:
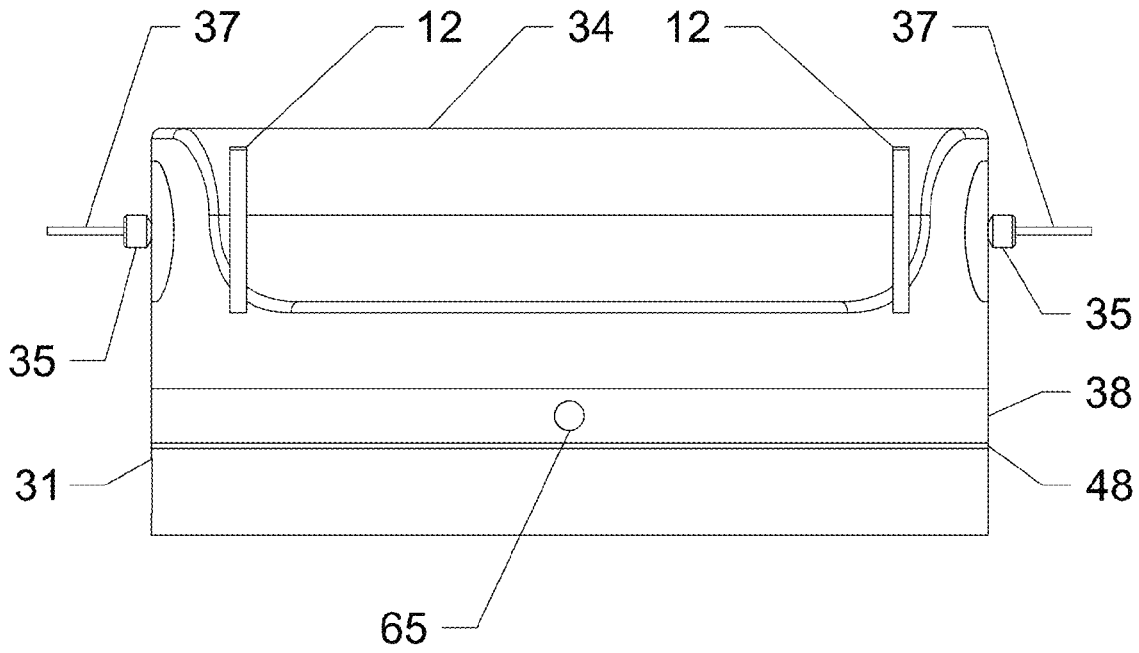
FIG. 6 shows a side view of the exterior of the BOP of FIG. 1, illustrating retaining members perpendicular to the ball screws and oriented such that the retaining members could be removed in a direction inward and/or outward from the figure.
Figure 7:
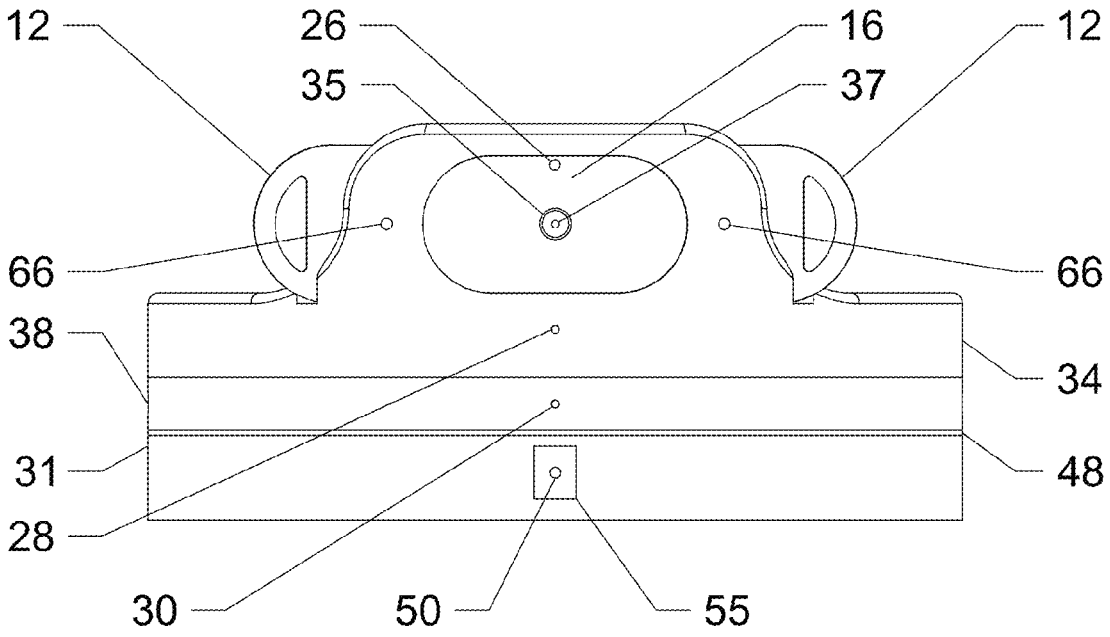
FIG. 7 shows a side view of exterior of the BOP of FIG. 1, rotated ninety degrees from the view shown in FIG. 6, illustrating retaining members perpendicular to the ball screw and to the field of view.
Figure 8:
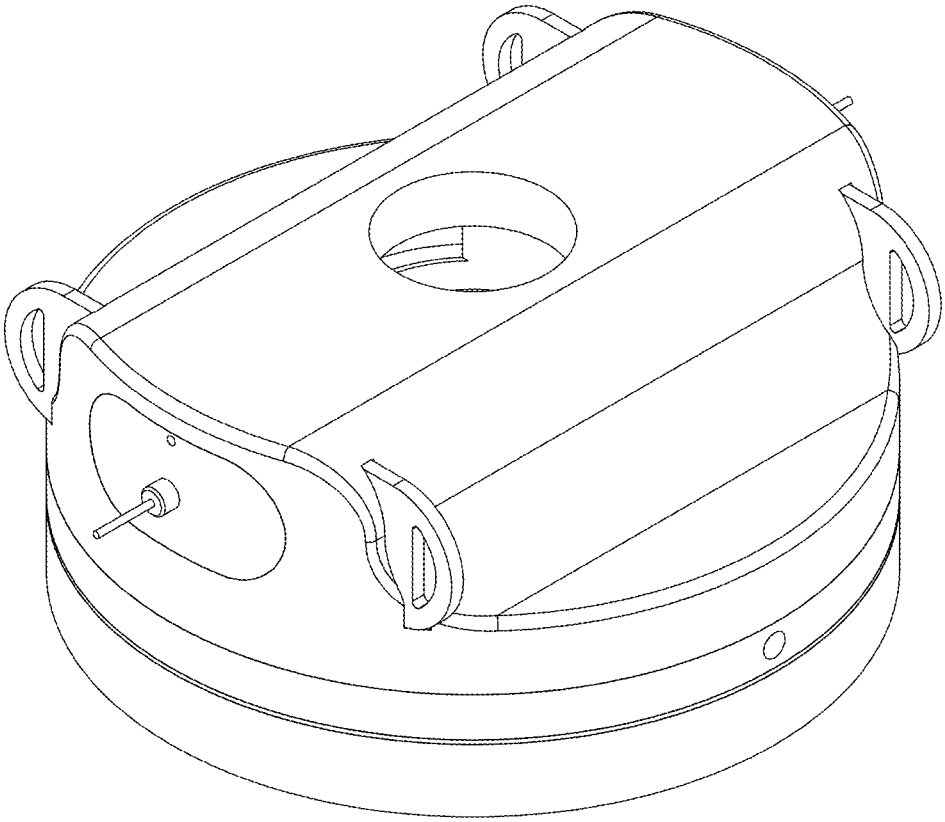
FIG. 8 shows a top isometric view of the exterior of the BOP of FIG. 1, in which retaining members and an open central portion of the BOP, placeable over a borehole, are visible.

As shown in FIG. 6 and FIG. 7, in an embodiment, for ease of manufacturing, maintenance, assembly, and/or transport, an upper housing 34, a lower housing 38, and a gas booster reservoir housing 31 (if used) can be constructed separately (e.g., for subsequent assembly). The depicted upper housing 34 contains the ram module 16, open port 26 (which may attach to an external accumulator (not shown) or hydraulic pumping unit (not shown)), intensifier piston 56 and high pressure passageway 71. The upper housing 34 can provide for easy and fast access to the ram module 16 and any associated components, e.g., by removing the retaining member(s) 12 and extracting the ram module 16. In an embodiment, the retaining components and/or ram module can be designed for removal using a ROV or other means (e.g., during subsea operations). As described previously, in various embodiments, the gas booster reservoir housing 31 can include a bolt-on module attachable to lower housing 38. In an embodiment, the gas booster reservoir housing 31 may not be required for the BOP to function, e.g., using hydraulic actuation via "close" port 30; however, the gas booster reservoir can add a failsafe measure, e.g., for redundancy and/or verification, and can also be used in conjunction with hydraulic actuation to provide increased pressure.

Referring to FIG. 3 and FIG. 4, when performing a closing operation under normal conditions, in one embodiment, hydraulic power can be used to actuate piston ram shaft 18 by flowing hydraulic fluid either from a line exiting the BOP itself or from an external source to power a hydraulic motor, which actuates the ball screw acting as ram position indicator rod 37. As the closing operation initiates, the piston ram shaft 18 moves toward the wellbore 64 and stops its advancement when the two opposing ram blocks 14 reach the farthest extension point toward and/or into, the wellbore 64. The advanced, seated ball screw, can contact the piston ram shaft 18 functions, such that the ball screw functions not only as a ram position indicator rod 37, but also serves to mechanically lock the piston ram shaft 18 and ram block 14 in the closed position, providing added assurance that the piston ram shaft 18 and ram block 14 cannot retract until actuated to do so. A variety of hydraulic configurations, including hydraulically operated motors, control, porting and redundant features, e.g., to enhance reliability, may accommodate ball screw assembly 35 to achieve desired function and fit. While use of a ball screw assembly 35 can add mass and/or slightly increase the footprint of the BOP, ball screw assemblies are generally significantly smaller than the ram cylinder extensions and boosters used with conventional BOPs. Other types of indicators, such as another type of mechanical indicator or screw, a mechanical or electronic counter with visible indicators actuated by motion of the ball screw and/or of the hydraulic motor, calibrated to indicate distance traveled by piston ram shaft 18, could be used without departing from the scope of the present disclosure.

Referring to FIG. 7, a side view of the exterior of the BOP is shown, at a position located behind the ball screw, ball screw assembly 35 and piston ram shaft 18, in which the gas charge port 50 and multi-port valve 55 are visible as well. The ram module 16 is shown retained in place by a retaining member 12. The depicted retaining member includes retaining pins or screws 66 used to fix the retaining member 12 in place, thereby preventing lateral movement thereof; however any manner of connector can be used without departing from the scope of the present disclosure, and in various embodiments, retaining members able to be secured in place in the absence of connectors (e.g., via force/interference fit, snapping and/or locking features, etc.) can be used. Identical or similar retaining pins or screws 66 can be used to secure an identical or similar retaining member on the opposing side of the BOP, not visible in FIG. 7. Removal of the retaining member(s) 12 can enable efficient access for removal or insertion of ram modules 16. In an embodiment, the ram module 16 can be inserted or removed from the ram cavity 4 as a complete unit, containing all associated ram components. The retaining member(s) 12 function to retain the ram module 16 in a generally fixed position relative to the BOP, e.g., when the ram module is activated and the piston ram shaft 18 causes the ram module 16 to exert force radially outward from the wellbore 64 as the piston ram shaft 18 moves inward toward the wellbore 64. As such, the retaining member 12 and ram module 16 can be sufficiently robust (e.g., comprised of sufficient mass and material strength) to withstand the forces created by the intensifier piston 56 during a closing operation.

BOP pressure control operations typically require an open access passageway extending through the entirety of the external BOP housing to the wellbore 64. In the depicted embodiment, FIG. 1, FIG. 2, FIG. 3, FIG. 4, FIG. 6 and FIG. 8 show a wellbore access passageway(s) 65 located on a side of the BOP, and in various embodiments, a wellbore access passageway could be located on each side of the lower housing 38, e.g., placed roughly in opposition to one another. In an embodiment, an API studded flange connection can be utilized at the outer circumference of the BOP, e.g., at the opening of the wellbore access passageway 65.

FIG. 6 shows a side view of the exterior of the BOP, generally perpendicular to the length of the ram modules 16, piston ram shafts 18 and ball screws acting as ram position indicator rods 37. In an embodiment, the retaining members 12 can be used as lifting points, e.g., for maneuvering the BOP, and can be removed by removing retaining pins or screws 66 therefrom, as shown in FIG. 7, then pulling the retaining members 12 away from the BOP (e.g., laterally, outward from the drawing). In an embodiment, the retaining members and/or retaining pins/screws can be configured for access and manipulation by a ROV (e.g., during subsea operations), enabling remote removal of retaining members 12 and interchanging of ram modules 16, e.g., as part of a maintenance operation.

As such, embodiments usable within the scope of the present disclosure can include a compact, stackable, high pressure, ram-type blowout preventer that is scalable in size (e.g., to accommodate various sizes of wellbores and associated equipment). Such BOPs can include a generally cylindrical upper and lower housing having an opening in the center through which at least one tubular may pass, e.g., for placement over a wellbore. An integrated intensifier can be positioned wholly within the BOP housing, having a low pressure side with greater surface area than a high pressure side, for actuation by hydraulic fluid or one or more gasses. In use, hydraulic fluid or gas exerts a force on the low pressure side, causing the high pressure side to exert a force on hydraulic fluid or one or more gasses gas, such that the fluid or gas at the high pressure side is at a higher pressure than fluid or gas at the low pressure side. As such, the fluid or gas on the high pressure side delivers an intensified pressure to hydraulic rams sufficient to perform a sealing and/or shearing operation.

In an embodiment, a BOP can include an insertable hydraulic ram module, held in place by retaining members or similar locking members, without the need for bonnets or doors.

In an embodiment, a BOP can include an attachable compressed gas reservoir. The gas reservoir could be usable to replace or supplement use of the hydraulic fluid or gas to enhance and/or independently perform a sealing and/or shearing operation.

In an embodiment, a BOP can include an indicator device (e.g., a mechanical indicator) usable to indicate the position of the hydraulic rams.

In an embodiment, a BOP can include a ball screw that is driven toward the wellbore as the hydraulic rams move during a sealing and/or shearing operation, such that the ball screw prevents unassisted retraction of the hydraulic rams, thereby impeding the hydraulic rams in the event of loss of pressure in the hydraulic fluid or gas used to drive the rams. The ball screw can be driven by a hydraulic motor that can be powered by hydraulic fluid on either the low or high pressure side of the intensifier and/or by an external fluid source. The ball screw can also function as an indicator device, usable to visually verify a position of the rams.

Embodied BOPs can be provided in stacks of two or more blowout preventers, and in various embodiments, can employ seal subs. In an embodiment, one or more interlocking "L" shaped fingers can act as locking connections and appropriate seals, enabling a first BOP to be stacked atop a second BOP, one of the BOPs having a plurality of "L" shaped protrusions while the other has a series of corresponding "L" shaped recessions/cutouts adapted to receive the protrusions. In use, after receiving the protrusions within corresponding recessions, one of the BOPs can be rotated relative to the other to lock the BOPs together. In an embodiment, a seal sub assembly can bridge the BOP surfaces, and the "L" shaped connections can be located behind the seal sub.

Although reference is made throughout the application to use of hydraulic fluid, it should be understood that any fluid, including liquids and gasses, could be employed without departing from the scope of the present disclosure. Furthermore, although discussed with specific reference to oil and/or gas wells, the disclosed subject matter has application in other areas that will be apparent to one skilled in the art after reading this disclosure, and this application is intended to include such other areas.

The invention claimed is:

1. An apparatus for containing pressure associated with a well, the apparatus comprising:

a housing;

a ram fluid chamber within the housing;

a ram piston within the housing, wherein the ram piston comprises a ram-piston first end engaged with a ram block and a ram-piston second end in communication with the ram fluid chamber, and wherein the ram piston is movable between an open position and a closed position;

an intensifier piston within the housing, wherein the intensifier piston comprises an intensifier-piston first end in communication with the ram fluid chamber and an intensifier-piston second end in communication with a primary fluid source, the intensifier-piston first end comprising intensifier-piston-first-end surface area, the intensifier-piston second end comprising an intensifier-piston-second-end surface area, the intensifier-piston-second-end surface area larger than the intensifier piston the intensifier-piston-first-end surface area, the intensifier piston comprising a top side positioned opposite the intensifier-piston second end, the top side laterally offset from the intensifier-piston first end;

wherein, at a first pressure, a first fluid from the primary fluid source applies a primary fluid force to the intensifier-piston second end to move the intensifier piston, wherein movement of the intensifier piston applies a second pressure to ram fluid in the ram fluid chamber, wherein the second pressure is greater than the first pressure, and wherein the second pressure applies a ram-piston force to the ram piston to urge the ram piston toward the closed position;

the apparatus comprising a clearance space within the housing, the clearance space laterally offset from the intensifier-piston first end to receive the top side for accommodating movement of the intensifier piston; and wherein the intensifier piston is adapted to move in a first direction responsive to the primary-fluid force applied to the intensifier-piston second end by first fluid from the primary fluid source thereby compressing a clearance space fluid in the clearance space, and wherein the intensifier piston is adapted to move in a second direction responsive to a clearance fluid pressure from compressed fluid in the clearance space.

2. The apparatus of claim 1, wherein the ram piston and the intensifier piston are in vertical alignment.

3. The apparatus of claim 1, wherein the ram piston is adapted for movement along a first axis and the intensifier piston is adapted for movement along a second axis, and wherein the second axis is perpendicular to the first axis.

4. The apparatus of claim 1, wherein the intensifier piston comprises an L-shaped cross-section.

5. The apparatus of claim 1, wherein the housing comprises a circular horizontal interior cross section.

6. The apparatus of claim 5, wherein the housing comprises a first portion containing the ram piston, wherein the first portion is adapted to contain the second pressure, and a second portion positioned adjacent the first portion.

7. The apparatus of claim 1, further comprising an insertable retaining member for retaining the ram piston within the housing, wherein the insertable retaining member is outwardly movable in a lateral direction relative to a ram piston longitudinal axis.

8. The apparatus of claim 7, wherein the ram piston is outwardly removeable along the ram piston longitudinal axis for accommodating repair, replacement, or maintenance thereof.

9. The apparatus of claim 1, further comprising a mechanical indicator engaged with the ram piston for verifying a position of the ram piston relative to the housing.

10. The apparatus of claim 9, wherein the mechanical indicator comprises an elongate member connected to the ram piston and movable therewith relative to the housing.

11. The apparatus of claim 1, further comprising a locking member movable to retain the ram piston in the closed position.

12. An apparatus for containing pressure associated with a well, the apparatus comprising:

a housing;

a ram fluid chamber within the housing;

a ram piston within the housing, wherein the ram piston comprises a ram-piston first end engaged with a ram block and a ram-piston second end in communication with the ram fluid chamber, and wherein the ram piston is movable between a closed position in which the ram block at least partially obstructs the well and an open position; and an intensifier piston within the housing, wherein the intensifier piston comprises an intensifier-piston first end in communication with the ram fluid chamber and an intensifier-piston second end in communication with a primary fluid source, the intensifier-piston first end comprising an intensifier-piston-first-end surface area, the intensifier-piston second end comprising an intensifier-piston-second-end surface area, the intensifier-pistion-second-end surface area larger than that of the intensifier-pistion- first end;

wherein, at a first pressure, a primary fluid from the primary fluid source applies a primary fluid force to the intensifier-piston second end to move the intensifier piston, wherein movement of the intensifier piston applies a second pressure to ram fluid in the ram fluid chamber, wherein the second pressure is greater than the first pressure, and wherein the second pressure applies a ram-piston force to the ram piston to urge the ram piston toward the closed position; and a secondary fluid source within the housing, the secondary fluid source adaptable for fluid communication with the intensifier-piston second end, wherein the secondary fluid source is actuatable to provide a secondary fluid to the intensifier-piston second end at a pressure sufficient to cause movement of the intensifier piston.

13. The apparatus of claim 12, wherein the secondary fluid source comprises a gas reservoir, a gas generating material, or combination thereof.

14. The apparatus of claim 13, wherein the gas reservoir is in vertical alignment with the ram piston and the intensifier piston.

15. An apparatus for containing pressure associated with a well, the apparatus comprising:

a housing;

a ram block at least partially positioned within the housing;

a ram fluid chamber within the housing;

a ram piston within the housing, wherein the ram piston comprises a ram-piston first end engaged with the ram block and a ram-piston second end in fluid communication with the ram fluid chamber;

an intensifier piston within the housing, wherein the intensifier piston comprises an intensifier-piston first end in communication with the ram fluid chamber and an intensifier-piston second end in communication with a primary fluid source, wherein the intensifier-piston first end comprises an intensifier-piston-first-end surface area, wherein the intensifier-piston second end comprises an intensifier-piston-second-end surface area, wherein the intensifier-piston second end is larger than the intensifier-piston-first-end surface area; and a clearance space within the housing, wherein the clearance space is adapted to accommodate movement of the intensifier piston;

wherein fluid from the primary fluid source applies a first pressure to the intensifier-piston second end to move the intensifier piston in a first direction, wherein movement of the intensifier piston in the first direction applies a second pressure to a ram fluid in the ram fluid chamber, the second pressure applied to ram fluid in the ram fluid chamber exceeds the first pressure, the movement of the intensifier piston in the first direction compresses clearance fluid in the clearance space, wherein the second pressure applied to ram fluid in the ram fluid chamber applies a force to the ram piston to urge the ram piston toward a closed position, and wherein the intensifier piston is adapted to move in a second direction opposite the first direction responsive to a clearance fluid force from compressed clearance fluid in the clearance space, and wherein movement of the intensifier piston in the second direction releases second pressure from the ram fluid to permit movement of the ram piston away from the closed position.

* * * * *